US010357674B2

(12) United States Patent
Grzegorz

(10) Patent No.: US 10,357,674 B2
(45) Date of Patent: Jul. 23, 2019

(54) AUTOMATICALLY DEPLOYED FIRE SUPPRESSION SPRINKLER

(71) Applicant: Marioff Corporation Oy, Vantaa (FI)

(72) Inventor: Laube Grzegorz, Gdansk (PL)

(73) Assignee: MARIOFF CORPORATION OY, Vantaa (FI)

( * ) Notice: Subject to any disclaimer, the term of this patent is extended or adjusted under 35 U.S.C. 154(b) by 0 days.

(21) Appl. No.: 15/529,319

(22) PCT Filed: Nov. 27, 2014

(86) PCT No.: PCT/FI2014/050921
§ 371 (c)(1),
(2) Date: May 24, 2017

(87) PCT Pub. No.: WO2016/083658
PCT Pub. Date: Jun. 2, 2016

(65) Prior Publication Data

US 2017/0259096 A1 Sep. 14, 2017

(51) Int. Cl.

| | |
|---|---|
| ***A62C 37/09*** | (2006.01) |
| ***B05B 15/70*** | (2018.01) |
| ***A62C 37/11*** | (2006.01) |
| ***A62C 37/14*** | (2006.01) |

(52) U.S. Cl.
CPC ..... *A62C 37/09* (2013.01); *A62C 37/11* (2013.01); *A62C 37/14* (2013.01); *B05B 15/70* (2018.02)

(58) Field of Classification Search
CPC ..... A62C 37/14; A62C 37/09; A62C 37/11; A62C 37/12; A62C 37/08; A62C 31/24; B05B 15/70–74; Y10T 137/1797
USPC ..... 169/37–41, 51, 56, 57, 42; 239/225.1–265
See application file for complete search history.

(56) References Cited

U.S. PATENT DOCUMENTS

| | | | |
|---|---|---|---|
| 3,067,823 | A | 12/1962 | Kavanagh |
| 4,015,665 | A | 4/1977 | Simons et al. |
| 4,121,665 | A | 10/1978 | Woycheese |

(Continued)

FOREIGN PATENT DOCUMENTS

| | | | |
|---|---|---|---|
| CN | 2643931 | Y | 9/2004 |
| CN | 201379932 | Y | 1/2010 |

(Continued)

OTHER PUBLICATIONS

International Search Report and Written Opinion for application PCT/FI2014/050921, dated Nov. 9, 2015, 8pgs.

*Primary Examiner* — Chee-Chong Lee
*Assistant Examiner* — Juan C Barrera
(74) *Attorney, Agent, or Firm* — Cantor Colburn LLP

(57) ABSTRACT

In one aspect, a fire suppression sprinkler assembly (10) is provided. The assembly includes a housing (20), and a sprinkler body (22) disposed at least partially within the housing and configured to supply a fluid to an area. The sprinkler body is movable between a first position where the sprinkler body is concealed within the housing and a second position where the sprinkler body extends from the housing to supply the fluid to the area heat responsive element (28) operatively associated with the sprinkler body and configured to facilitate preventing deployment of the sprinkler body from the first position to the second position until the heat responsive element senses a predetermined temperature.

10 Claims, 2 Drawing Sheets

(56) References Cited

U.S. PATENT DOCUMENTS

| | | | | |
|---|---|---|---|---|
| 4,766,961 | A | 8/1988 | Macie | |
| 4,957,169 | A | 9/1990 | Polan | |
| 5,083,616 | A | 1/1992 | Polan | |
| 5,234,059 | A | 8/1993 | Eynon | |
| 5,494,114 | A | 2/1996 | Hoening et al. | |
| 5,609,211 | A | 3/1997 | Meyer et al. | |
| 5,967,238 | A | 10/1999 | Pepi et al. | |
| 6,308,784 | B1 | 10/2001 | Mears | |
| 6,868,916 | B2 | 3/2005 | Petersen | |
| 8,176,988 | B2 | 5/2012 | Fischer | |
| 8,544,556 | B2 | 10/2013 | Sundholm et al. | |
| 2010/0212917 | A1 | 8/2010 | Mehr | |
| 2011/0186310 | A1 | 8/2011 | Issartal | |
| 2013/0020406 | A1* | 1/2013 | Koiwa ..... | A62C 35/68<br>239/209 |
| 2014/0174768 | A1 | 6/2014 | Bucher et al. | |

FOREIGN PATENT DOCUMENTS

| | | | |
|---|---|---|---|
| WO | 2013132152 | A2 | 9/2013 |
| WO | 2014084954 | A2 | 6/2014 |

* cited by examiner

AUTOMATICALLY DEPLOYED FIRE SUPPRESSION SPRINKLER

FIELD OF THE INVENTION

The subject matter disclosed herein relates to fire suppression systems and, more specifically, to automatically deployed mechanical fire suppression systems.

BACKGROUND

Fire suppression systems typically include sprinklers positioned within an area where fire protection is desired. Such sprinklers may be operated individually such as by a self-contained thermally sensitive element, or as part of a deluge system in which fire retardant fluid flows through a number of open sprinklers. Fire retardant fluids may include water or appropriate mixtures of water and one or more additives to enhance firefighting properties of a fire suppression system.

However, some sprinklers may include parts that project into the area where fire protection is desired, which may be undesirable. For example, the projecting parts may be aesthetically displeasing when present in living spaces. Accordingly, it is desirable to provide a fire suppression system with concealed sprinklers.

WO 2014/084954 describes a fire suppression sprinkler assembly having a cover plate mounted adjacent the first end of a separate sprinkler.

BRIEF DESCRIPTION OF THE INVENTION

In one aspect, a fire suppression sprinkler assembly (10) is provided. The assembly includes a housing (20), and a sprinkler body (22) disposed at least partially within the housing and configured to supply a fluid to an area. The sprinkler body is movable between a first position where the sprinkler body is concealed within the housing and a second position where the sprinkler body extends from the housing to supply the fluid to the area heat responsive element (28) operatively associated with the sprinkler body and configured to facilitate preventing deployment of the sprinkler body from the first position to the second position until the heat responsive element senses a predetermined temperature.

In addition to one or more of the features described above, or as an alternative, further embodiments may include wherein the heat responsive element is a fluid containing heat bulb (80) exposed to the area; an undercut (76) is formed in an exposed surface (78) of the sprinkler body and wherein the heat responsive element is disposed at least partially within the undercut; a second undercut (48) is formed in an exposed surface (16) of the housing and wherein the heat responsive element is disposed at least partially within the second undercut; wherein the sprinkler body is rotatably coupled to the housing such that the sprinkler body rotates as it transitions from the first position to the second position, wherein the housing includes an inlet opening (40) configured to couple to a fluid supply line; wherein the inlet opening is configured to receive a fluid supply such that the sprinkler assembly is fluidly pressurized when the sprinkler body is in the first position; wherein the sprinkler body comprises a curved slot (54) formed in an outer surface of the sprinkler body; a steering pin (24) extending through at least a portion (46) of the housing and disposed at least partially within the curved slot; a standby plug (62) coupled to the housing and configured to extend into a main fluid channel (50) of the sprinkler body when the sprinkler body is in the first position; and/or wherein the sprinkler body comprises a main channel (50) and a plurality of nozzles (52) fluidly coupled to the main channel, wherein in the second position the sprinkler body main channel is configured to receive a fluid and supply the fluid to the nozzles for dispersion into the area.

In another aspect, a method of manufacturing a fire suppression sprinkler assembly (10) is provided. The method includes providing a housing (20), disposing a sprinkler body (22) at least partially within the housing such that the sprinkler body is movable between a first position where the sprinkler body is concealed within the housing and a second position where the sprinkler body extends from the housing to supply a fluid to an area, and operatively associating a heat responsive element (28) with the sprinkler body such that the heat responsive element facilitates preventing deployment of the sprinkler body from the first position to the second position until the heat responsive element senses a predetermined temperature.

In addition to one or more of the features described above, or as an alternative, further embodiments may include disposing the heat responsive element in an undercut (76) formed in an exposed surface (78) of the sprinkler body; disposing the heat responsive element in a second undercut (48) formed in an exposed surface (16) of the housing; rotatably coupling the sprinkler body to the housing such that the sprinkler body rotates as it transitions from the first position to the second position; providing the sprinkler body with a curved slot (54) formed in an outer surface of the sprinkler body; and/or disposing a steering pin (24) through at least a portion (46) of the housing and at least partially within the curved slot.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION OF THE INVENTION

Figure 2:
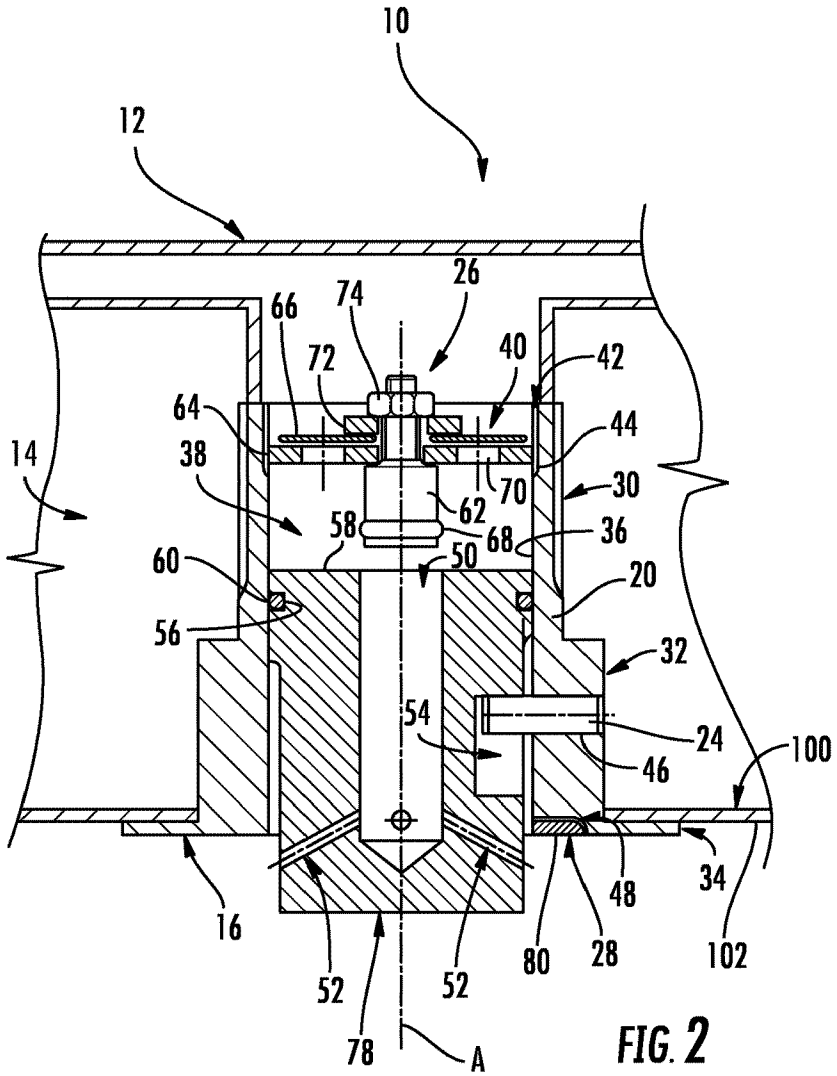
FIG. 2 is a cross-sectional view of the fire suppression sprinkler assembly in a deployed second position.
Figure 1:
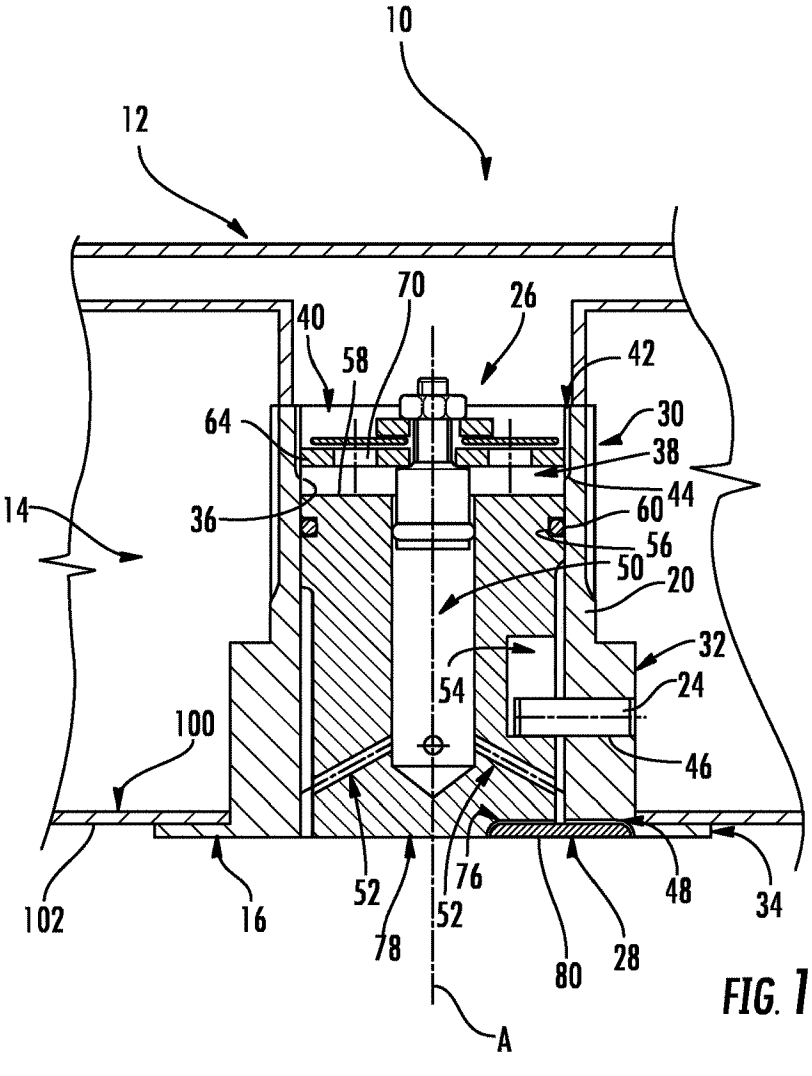
FIG. 1 is a cross-sectional view of an exemplary fire suppression sprinkler assembly in a retracted first position.

FIGS. 1 and 2 illustrate an exemplary fire suppression sprinkler assembly 10 that generally includes a fluid supply line 12 fluidly coupled to fire suppression sprinkler 14 that may be mounted to a portion of a building, ship, or other structure. For example, as illustrated, sprinkler 14 is mounted to a ceiling 100 such that a sprinkler bottom surface 16 is flush or substantially flush with a ceiling outer surface 102. Accordingly, in an inactive state, sprinkler 14 is substantially concealed within ceiling 100. However, during an active state for fire suppression, sprinkler 14 is automatically deployed from ceiling 100, as shown in FIG. 2 and described herein in more detail.

In the exemplary embodiment, fire suppression sprinkler 14 generally includes a housing 20, a spindle or sprinkler body 22, a steering pin 24, a plug and strainer assembly 26, and a heat bulb assembly 28.

Figure 6:
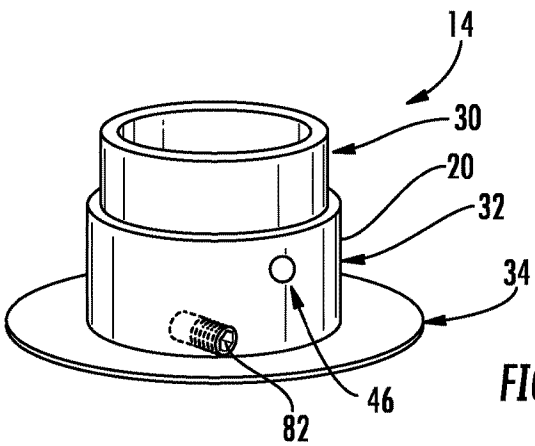
FIG. 6 is a perspective view of an exemplary housing that may be used with the assembly shown in FIGS. 1 and 2.
Figure 3:
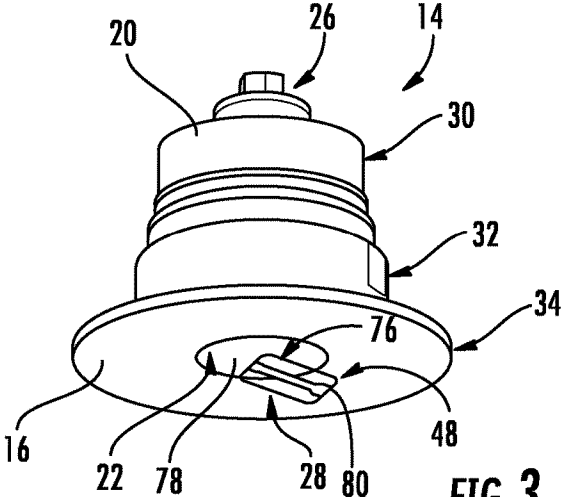
FIG. 3 is a perspective view of an exemplary sprinkler of the assembly shown in FIGS. 1 and 2.

Housing 20 includes an upper portion 30, an intermediate portion 32, and a lower portion 34 (see also FIGS. 3 and 6). Housing 20 also includes an inner wall 36 defining an opening 38 that extends through housing 20 and is configured to receive sprinkler body 22. Once installed, lower portion 34 is positioned against ceiling surface 102, and housing 20 is fluidly coupled to fluid supply line 12 to receive water or other fire suppression fluid. In the exemplary embodiment, portions 30, 32, 34 are circular or generally circular. However, portions 30, 32, 34 may have any suitable shape that enables assembly 10 to function as described herein.

In the exemplary embodiment, upper portion 30 defines a housing inlet end 40 and includes a cutout, thread, or recess 42 formed within inner wall 36 to define a shoulder 44 configured to support at least a portion of plug and strainer assembly 26. Intermediate portion includes a bore or opening 46 configured to receive steering pin 24 (see also FIG. 6), and lower portion 34 includes an undercut or recess 48 formed in sprinkler bottom surface 16 to receive heat bulb assembly 28 (see also FIGS. 3 and 4).

Figure 5:
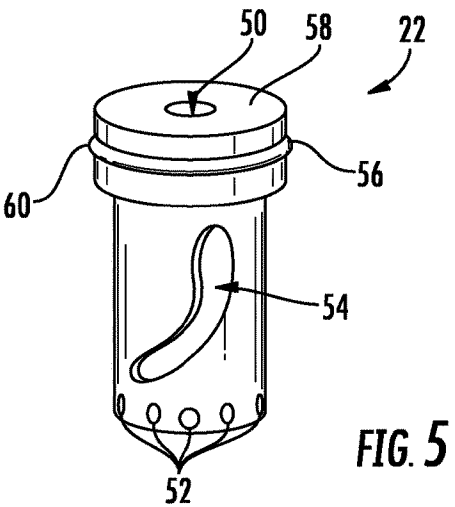
FIG. 5 is a perspective view of an exemplary sprinkler body that may be used with the assembly shown in FIGS. 1 and 2.

Sprinkler body 22 is rotatably disposed within housing 20 and generally includes a main channel 50, a plurality of nozzles 52, a curved slot 54, and a recess 56. Main channel 50 is formed in a top surface 58 of body 22 and extends substantially centrally therethrough along an axis 'A'. Main channel 50 is fluidly coupled to nozzles 52 and is configured to supply a fire suppression fluid from housing inlet 40 to nozzles 52. Curved slot 54 is formed within sprinkler body 22 (see also FIG. 5) and is configured to receive at least a portion of steering pin 24 therein. Due to the curvature of slot 54, sprinkler body 22 is configured to twist within housing opening 38 as it translates up and down, as is described herein in more detail. Recess 56 is configured to receive an O-ring or seal 60 configured to facilitate providing a fluid seal between sprinkler body 22 and housing 20.

Steering pin 24 is disposed within and extends through housing opening 46 and sprinkler body curved slot 54. Due to fluid pressure acting on sprinkler body top surface 58, sprinkler body 22 is urged downward toward sprinkler bottom surface 16. As body 22 is urged downward, steering pin 24 acts against the inner wall of curved slot 54, which creates a twisting force or torque on body 22. In an inactive state, a structure or object is used to counteract that torque to prevent deployment of sprinkler body 22 from within housing 20 and ceiling 100. For example, in the exemplary embodiment, heat bulb assembly 28 is configured to counteract the torque of body 22, as is described herein in more detail. Alternatively, any suitable means may be used to prevent twisting of body 22 and subsequent deployment thereof.

Plug and strainer assembly 26 is disposed within housing upper portion 30 and generally includes a standby plug 62, a fluid supply regulator 64, and a fluid strainer 66. Standby plug 62 includes an O-ring or seal 68 and is configured to facilitate providing a fluid seal between standby plug 62 and sprinkler body 22 when plug 62 is at least partially disposed within main channel 50 and sprinkler 14 is in the inactive state (FIG. 1). Fluid supply regulator 64 is disposed about plug 62 (on shoulder 44) and includes one or more openings 70 to enable fire suppression fluid delivery from inlet 40 to body main channel 50 when sprinkler 14 is in the active state (FIG. 2). Fluid strainer 66 is disposed about plug 62 against regulator 64 to facilitate capture of debris that may block or obstruct fluid flow through portions of sprinkler 14 (e.g., through nozzles 52). A washer 72 and nut 74 are assembled on standby plug 62 to secure fluid supply regulator 64 and fluid strainer 66 to standby plug 62.

Figure 4:
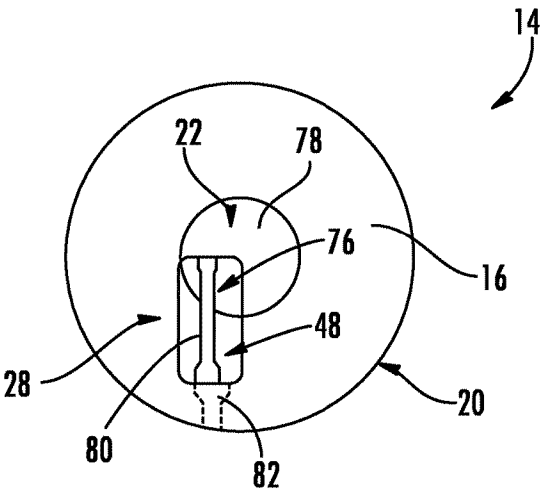
FIG. 4 is a bottom view of the sprinkler shown in FIG. 3.

Heat bulb assembly 28 is disposed within housing undercut 48 and within a body undercut 76 formed in a bottom surface 78 of sprinkler body 22, as further illustrated in FIGS. 3 and 4. Heat bulb assembly 28 generally includes a heat bulb or other heat responsive element 80 and a fastener 82 to secure heat bulb within undercuts 48, 76. In the exemplary embodiment, fastener 82 is a headless socket screw. However, fastener 82 may be any suitable fastener or structure configured to secure heat responsive element 80 within assembly 10.

Heat bulb 80 is disposed within undercuts 48, 76 and retains sprinkler body 22 in the inactive position (FIG. 1). For example, as shown in FIG. 4, heat bulb 80 is disposed across both housing 20 and body 22 to prevent relative rotation therebetween. In this orientation, heat bulb 80 is directly exposed to the space or area where fire protection is desired.

When experiencing an elevated temperature, such as in the presence of a fire for example, a fluid within heat bulb 80 expands, causing the bulb to break, and thereby allowing sprinkler body 22 to transition or deploy to an active, operating state where body 22 extends from housing 20 and ceiling 100 to expose nozzles 52 (FIG. 2). Although a fluid bulb is described herein, sprinkler assembly 10 may include other heat responsive elements that enable sprinkler assembly 10 to function as described herein.

In operation, when sprinkler 14 is in the inactive state illustrated in FIG. 1, sprinkler body 22 is disposed within housing 20 such that bottom surface 78 is flush with or substantially flush with sprinkler bottom surface 16. In this position, sprinkler 14 is substantially concealed within ceiling 100. Fluid supply line 12 is pressurized and fluid enters sprinkler inlet 40. However, sprinkler body 22 is fluidly sealed against housing inner wall 36 via seal 60, and standby plug 62 is fluidly sealed within main channel 50, to facilitate preventing fluid from exiting sprinkler 14. Further, sprinkler body 22 is maintained in the retracted position by heat bulb assembly 28, which counteracts the torque acting on body 22 caused by fluid pressure on body top surface 58 acting through the interaction between the inner wall of curved slot 54 and steering pin 24.

During a high temperature event (e.g., a fire), heat responsive element 80 breaks or is otherwise activated, which decreases or removes the counteracting torque. As such, the fluid pressure acting on sprinkler body top surface 58 forces sprinkler body 22 downward such that it is deployed and extends from housing 20 (FIG. 2). As sprinkler body 22 moves downward, the edge walls of curved slot 54 ride along steering pin 24, which causes a twisting or rotating motion of sprinkler body 22 as it descends from housing. Once deployed in the activated position (FIG. 2), standby plug 62 is no longer disposed within main channel 50, thereby enabling fire suppression fluid to flow through strainer 66, regulator 64 and into main channel 50 where the fire suppression fluid is subsequently directed into the plurality of nozzles 52 and dispersed into the area where fire protection is desired.

The systems and methods described herein provide a fire suppression sprinkler assembly that is concealed within a structure and mechanically deployed during a high temperature event. Accordingly, no electronics are needed to activate the sprinkler assembly, which may facilitate a shorter reaction time to the elevated temperatures. Further, the fluid supply line is pressurized in the inactive state, which prevents the need to fill the fluid supply line during activation. Moreover, the heat bulb is always exposed to the environment, so there is no need to wait until the heat bulb is heated after a deployment.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A fire suppression sprinkler assembly comprising: a housing; a sprinkler body disposed at least partially within the housing and configured to supply a fluid to an area, the sprinkler body movable between a first position where the sprinkler body is concealed within the housing and a second position where the sprinkler body extends from the housing to supply the fluid to the area; and a heat responsive element operatively associated with the sprinkler body and configured to facilitate preventing deployment of the sprinkler body from the first position to the second position until the heat responsive element senses a predetermined temperature; wherein the sprinkler body comprises a curved slot formed in an outer surface of the sprinkler body; further comprising a steering pin extending through at least a portion of the housing and disposed at least partially within the curved slot; wherein the sprinkler body is rotatably coupled to the housing via the curved slot and the steering pin, which cause the sprinkler body to rotate as it transitions from the first position to the second position.

2. The assembly of claim 1, wherein the heat responsive element is a fluid containing heat bulb exposed to the area.

3. The assembly of claim 1, wherein an undercut is formed in an exposed surface of the sprinkler body, and wherein the heat responsive element is disposed at least partially within the undercut.

4. The assembly of claim 3, wherein a second undercut is formed in an exposed surface of the housing, and wherein the heat responsive element is disposed at least partially within the second undercut.

5. The assembly of claim 1, wherein the housing includes an inlet opening configured to couple to a fluid supply line, wherein the inlet opening is configured to receive a fluid supply such that the sprinkler assembly is fluidly pressurized when the sprinkler body is in the first position.

6. The assembly of claim 1, further comprising a standby plug coupled to the housing and configured to extend into a main fluid channel of the sprinkler body when the sprinkler body is in the first position.

7. The assembly of claim 1, wherein the sprinkler body comprises a main channel and a plurality of nozzles fluidly coupled to the main channel, wherein in the second position the sprinkler body main channel is configured to receive a fluid and supply the fluid to the nozzles for dispersion into the area.

8. A method of manufacturing a fire suppression sprinkler assembly, the method comprising: providing a housing; disposing a sprinkler body at least partially within the housing such that the sprinkler body is movable between a first position where the sprinkler body is concealed within the housing and a second position where the sprinkler body extends from the housing to supply a fluid to an area; operatively associating a heat responsive element with the sprinkler body such that the heat responsive element facilitates preventing deployment of the sprinkler body from the first position to the second position until the heat responsive element senses a predetermined temperature; providing the sprinkler body with a curved slot formed in an outer surface of the sprinkler body; and disposing a steering pin through at least a portion of the housing and at least partially within the curved slot; and rotatably coupling the sprinkler body to the housing via the curved slot and the steering pin, thus causing the sprinkler body to rotate as it transitions from the first position to the second position.

9. The method of claim 8, further comprising disposing the heat responsive element in an undercut formed in an exposed surface of the sprinkler body.

10. The method of claim 9, further comprising disposing the heat responsive element in a second undercut formed in an exposed surface of the housing.

* * * * *